US005895318A

United States Patent [19]

Smrt

[11] Patent Number: 5,895,318

[45] Date of Patent: Apr. 20, 1999

[54] APPARATUS AND METHOD FOR SELECTIVELY DISPENSING OXYGEN FROM AN AEROSOL CONTAINER

[76] Inventor: Thomas J. Smrt, 9716 S. Grant Hwy., Marengo, Ill. 60152

[21] Appl. No.: 08/711,802

[22] Filed: Sep. 10, 1996

[51] Int. Cl.[6] ..... F24F 11/00

[52] U.S. Cl. ..... 454/256; 454/254; 454/902

[58] Field of Search ..... 454/75, 143, 254, 454/256, 902; 600/21, 22

[56] References Cited

U.S. PATENT DOCUMENTS

| | | | |
|---|---|---|---|
| 3,617,214 | 11/1971 | Dolac . | |
| 3,739,944 | 6/1973 | Rogerson . | |
| 3,779,425 | 12/1973 | Werner . | |
| 4,057,205 | 11/1977 | Vensel | 454/75 X |
| 4,348,888 | 9/1982 | Snee . | |
| 4,526,752 | 7/1985 | Perlman et al. . | |
| 4,582,054 | 4/1986 | Ferrer . | |
| 4,601,882 | 7/1986 | Benner . | |
| 4,983,913 | 1/1991 | Krause et al. . | |
| 5,168,323 | 12/1992 | Purtschert et al. . | |
| 5,285,916 | 2/1994 | Ross . | |
| 5,486,811 | 1/1996 | Wehrle et al. . | |

FOREIGN PATENT DOCUMENTS

| | | | |
|---|---|---|---|
| 57-184844 | 11/1982 | Japan | 454/256 |

*Primary Examiner*—Harold Joyce
*Attorney, Agent, or Firm*—Leydig, Voit & Mayer, Ltd.

[57] ABSTRACT

An apparatus and related method for selectively dispensing oxygen into an enclosed space is provided. The apparatus includes a pressurized container comprising oxygen and an actuator which can be moved between discharging and non-discharging positions, a means for mounting the pressurized container such that upon discharge the container will dispense oxygen into the enclosed space, an electrically-operable actuating means which effects movement of the pressurized container actuator between the discharging and non-discharging positions, and a sensor disposed in the enclosed space and in electrical connection with the actuating means for detecting a preselected property of the atmosphere in the enclosed space, wherein when the sensor detects the certain preselected property, the actuating means moves the aerosol container actuator into the discharging position, thereby providing for oxygen to be discharged into the enclosed space.

11 Claims, 3 Drawing Sheets

APPARATUS AND METHOD FOR SELECTIVELY DISPENSING OXYGEN FROM AN AEROSOL CONTAINER

FIELD OF THE INVENTION

This invention generally relates to devices for dispensing oxygen and, more particularly, to an apparatus and method for selectively dispensing oxygen from an aerosol container into an enclosed space.

BACKGROUND OF THE INVENTION

In certain circumstances, the amount of oxygen present in an enclosed space can reach undesirably low levels, e.g., in crowded, relatively air-tight enclosures such as elevators, buses, passenger compartments in airplanes and trains, and conference rooms. This problem can be very serious where other harmful gases are present in the enclosed space, e.g., carbon monoxide in a garage or basement of a home.

Thus, a need exists for an apparatus and method which can be used to augment the amount of oxygen in an enclosed space when the oxygen level reaches a predetermined minimum. It would be advantageous if such an apparatus utilized relatively simple components, thereby making the apparatus relatively low in cost and enabling the source of the oxygen to be changed out quickly and easily when it is exhausted.

SUMMARY OF THE INVENTION

The present invention provides a solution to the foregoing and other problems by providing an apparatus for selectively dispensing oxygen into an enclosed space having an atmosphere. In one preferred embodiment, the apparatus of the present invention comprises a pressurized container comprising oxygen and an actuator which can be moved between discharging and non-discharging positions, means for mounting the pressurized container such that upon discharge the container will dispense oxygen into the enclosed space, electrically-operable actuating means which effects movement of the pressurized container actuator between the discharging and non-discharging positions, and a sensor disposed in the enclosed space and in electrical connection with the actuating means for detecting a preselected property of the atmosphere in the enclosed space, wherein when the sensor detects the certain preselected property, the actuating means moves the aerosol container actuator into the discharging position, thereby providing for oxygen to be discharged into the enclosed space.

The present invention also provides a method for selectively dispensing oxygen into an enclosed space having an atmosphere. In a preferred embodiment, the method comprises the steps of sensing the atmosphere in the space for a selected property, and automatically dispensing oxygen from a pressurized container which comprises oxygen into the enclosed space when the selected property is sensed.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

In accordance with one preferred embodiment of the present invention, there is provided an apparatus and a method for selectively dispensing oxygen from a pressurized container into an enclosed space, such as a room, an elevator, or the passenger compartment of a motor vehicle. The apparatus and method are useful in situations where the oxygen level (concentration) in an enclosed space falls below a desired level. Such drops in oxygen levels can be observed in rooms that become overcrowded, and when a harmful gas is introduced into an enclosed space, e.g., carbon monoxide in a garage, manufacturing facility, or home. The ability to overcome the aforementioned concerns by use of the apparatus and method of the present invention, which provide an economical and elegantly simple solution, would be of great benefit.

Figure 1:
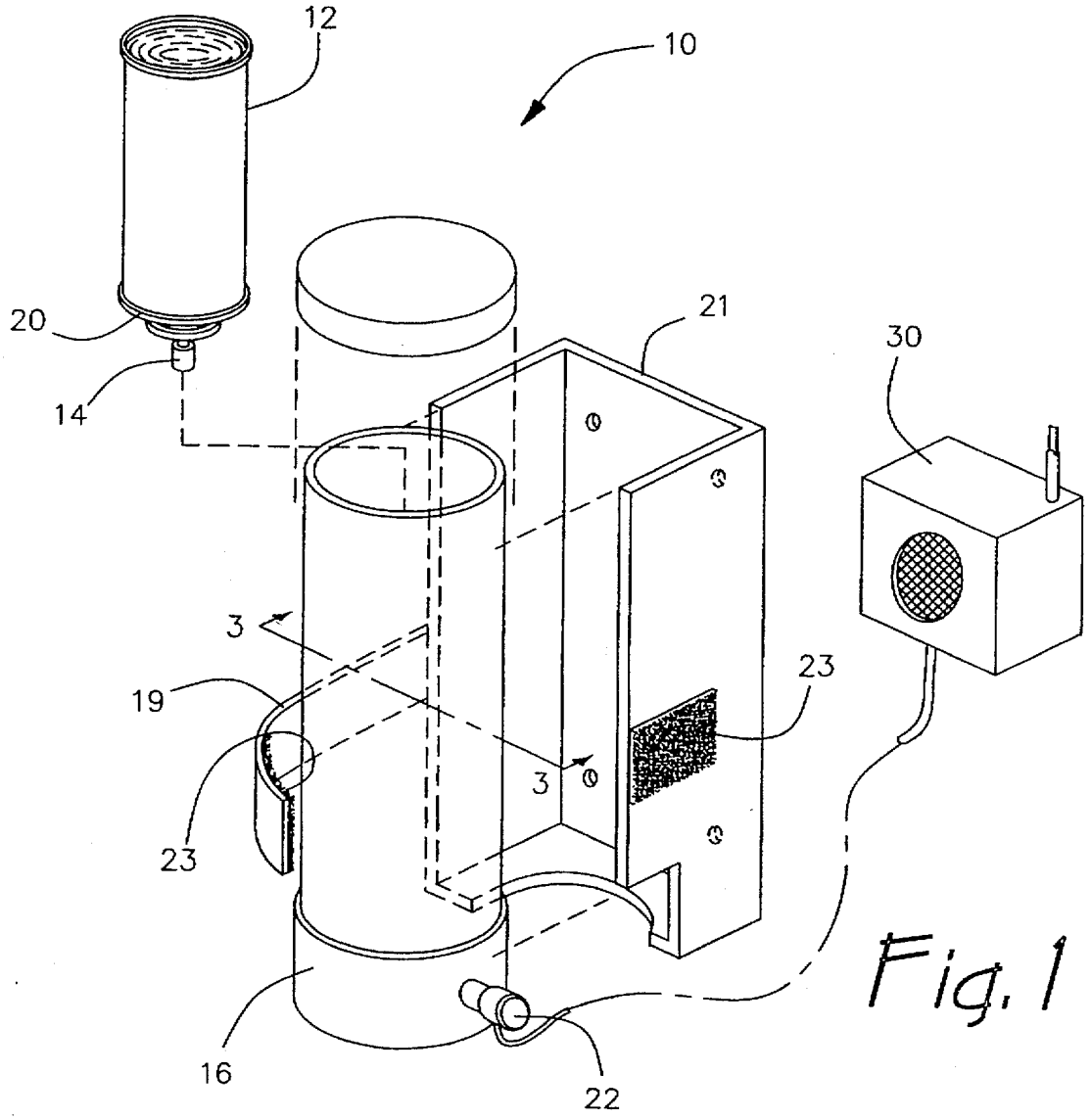
FIG. 1 is a perspective view of an apparatus for selectively dispensing oxygen from a pressurized container constructed according to one embodiment of the present invention.
Figure 2:
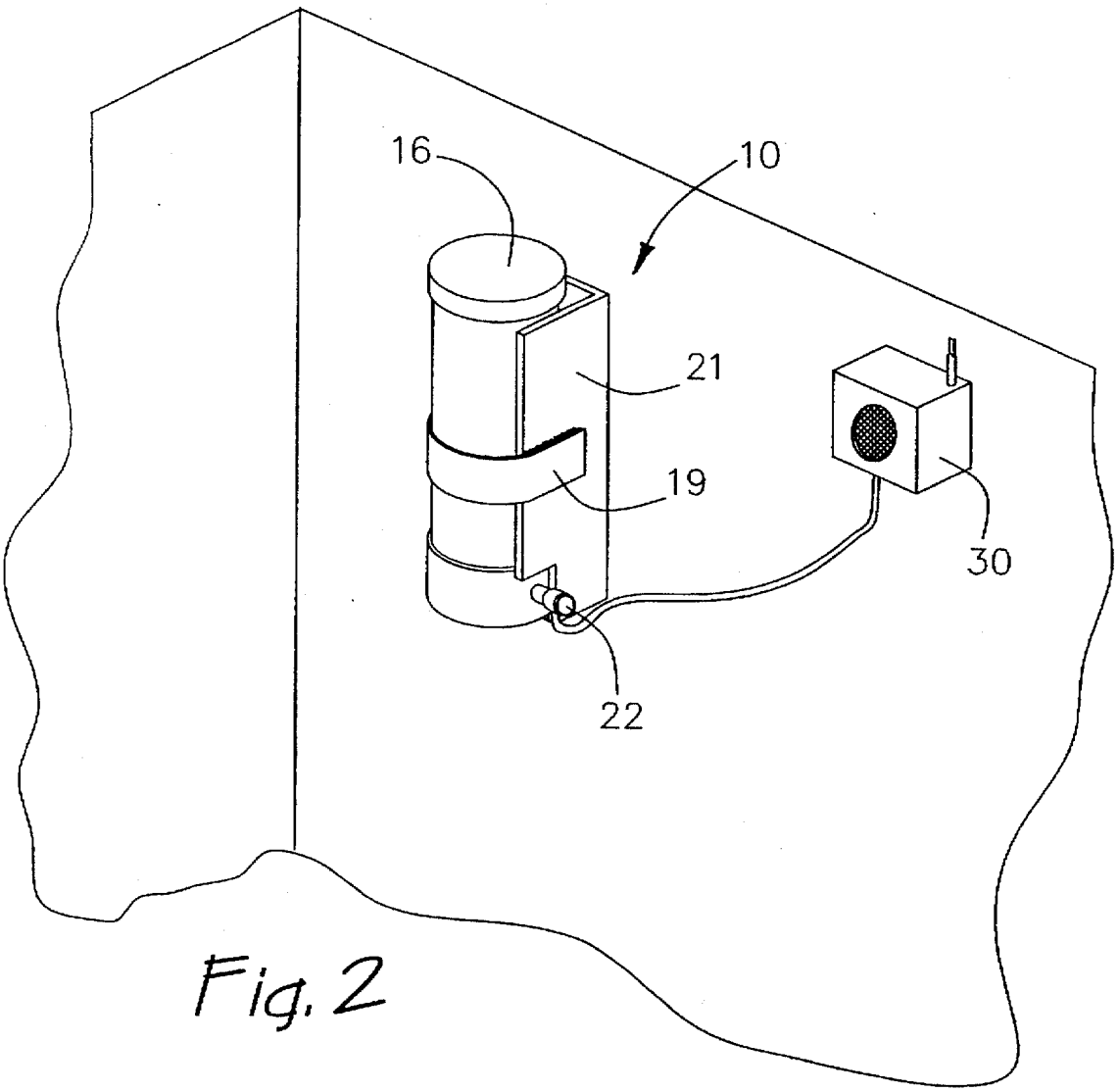
FIG. 2 is perspective view of the oxygen dispensing apparatus of FIG. 1 showing how the apparatus could be mounted in an enclosure.
Figure 3:
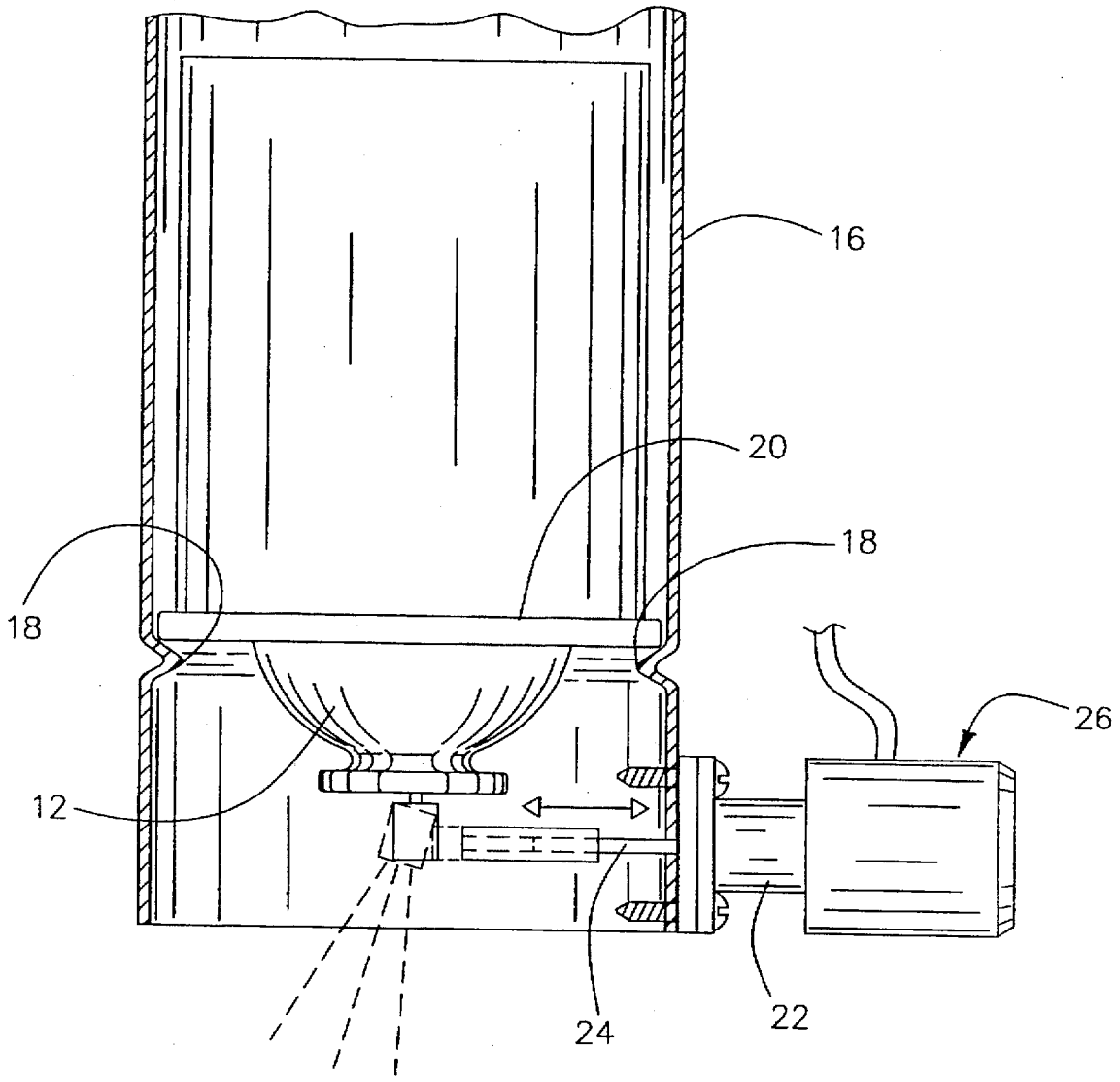
FIG. 3 is a sectional view taken along line 3—3 of FIG. 1 showing the discharging position of the pressurized container actuator and the extended position of the solenoid arm in broken lines and the non-discharging position of the pressurized container actuator and the retracted position of the solenoid arm in solid lines.

Turning to FIGS. 1–3, there is illustrated a preferred embodiment of the oxygen dispensing apparatus 10 of the present invention. As shown in the drawings, the apparatus can be used with conventional aerosol containers 12 which are pressurized upon being filled with oxygen. Preferably, the oxygen used to fill the container will be substantially free of any other gases (in accordance with commercially-established standards of purity).

The aforesaid containers, which are typically used to hold aerosol paints, are preferred because they are relatively inexpensive, and allow a consumer to readily transport and change-out one container for a new container after a particular container is fully discharged. It should be appreciated, however, that any type of container that is compatible with this and other aspects of the present invention may be utilized. The pressurized container 12 also includes an actuator 14 that moves between non-discharging and discharging positions, thereby controlling the discharge of the oxygen in the container. As will be appreciated by those skilled in the art, any type of actuator which allows the valve of the container to be opened, and the oxygen therein to be discharged, may be used in connection with the present invention.

The oxygen dispensing apparatus 10 further includes means for mounting the container 12 which allows the oxygen that is discharged from the pressurized container to be dispensed into the enclosed space. As will be appreciated by those skilled in the art, there are any number of different configurations of mounting structures, and mounting positions, that can be used to mount the container such that it will dispense oxygen into the enclosed space. Preferably, the mounting means is configured such that the container can be easily removed and replaced when the oxygen in the container is exhausted.

In a preferred embodiment, the container mounting means comprises a generally cylindrical structure 16 which is adapted to receive and securely retain the container 12, as exemplified in FIG. 1. In the illustrated embodiment, the cylindrical structure 16 includes an annular flange 18 which serves to properly align and position the container within the cylindrical structure. The annular flange includes a central opening which allows the top of the container including the actuator 14, to extend therethrough. The annular flange 18 is sized so as to contact a ridge portion 20 which extends from a typical aerosol (e.g., paint) container. Unlike the illustrated embodiment wherein the container 12 is held in the inverted position, in another embodiment, the mounting structure 16 could be configured such that container is held in an upright or other position, as the orientation of the container is of no consequence regarding the ability of the container to discharge oxygen into the enclosed space.

Those skilled in the art will also appreciate that the container 12 could also be mounted in any number of different locations. For example, the aerosol container 12 could be mounted onto a surface which defines the enclosed space, e.g., a wall of a room as shown in FIG. 2. Alternatively, the container 12 could be mounted to the ceiling of such a room, or outside of the enclosure, e.g., air supply ducts, where the discharged oxygen be dispensed within the enclosed space. In the illustrated embodiment, the cylindrical structure 16 with the container 12 can be mounted on a surface such as a wall via a mounting bracket 21. The mounting bracket 21 is adapted such that the cylindrical structure 16, and with it the container 12, can be easily removed and replaced. In particular, the cylindrical structure 16 is held in the mounting bracket by a strap 19 which is provided with a conventional hook and loop fastener 23.

In order to effectuate movement of the container actuator 14 between the discharging and non-discharging positions, the oxygen dispensing apparatus includes electrically-operable actuating means. Preferably, the actuating means comprises a solenoid 22 that includes an arm 24 mounted to a housing 26, as exemplified in FIG. 3. The solenoid arm 24 is mounted to the solenoid housing 26 so that the solenoid arm 24 can move relative to the solenoid housing between retracted or non-discharging and extended or discharging positions in response to a flow of current to the solenoid 22.

Generally, discharge of the container contents is affected by moving the actuator 14 from its normal, non-discharging, position into a discharging position, wherein the spring-biased container valve (not shown) is opened. While various types of actuators and biased valves may be used, and are well known in the art, valves that are opened when the actuator is moved laterally with respect to the longitudinal axis of the container are preferred. Of course, and as will be appreciated by those skilled in the art, the actuating means could be designed to accommodate one or more types of aerosol container valve and actuator combinations.

In the illustrated embodiment, when the solenoid 22 is energized, the arm 24 extends outwardly from the solenoid 22 in a direction transverse to the longitudinal axis of the container actuator 14 into the extended or discharging position, shown in broken lines in FIG. 3. In the extended or discharging position, the solenoid arm 24 effects movement of the aerosol can actuator 14 into the discharging position, thus opening the container valve and allowing oxygen in the container to be discharged. When the solenoid 22 is de-energized, a spring (not shown) in the aerosol container valve (not shown) biases the actuator 14 back into the non-discharging position, thereby pushing the solenoid arm 24 back into the retracted or non-discharging position, shown in solid lines in FIG. 2, and closing the container valve.

The oxygen dispensing apparatus also includes a sensor 30 disposed in the enclosed space and in electrical connection with the actuating means 22 for detecting a preselected property (e.g., oxygen concentration, carbon monoxide concentration) of the atmosphere in the space. When the sensor 30 detects the preselected property, it signals the actuating means, the solenoid 22 in the illustrated embodiment, to effect movement of the container actuator 14 into the discharging position, thereby dispensing oxygen into the enclosed space. The oxygen dispensing apparatus 10 can be configured such that the actuating means 22 will continue to cause the container 12 to dispense oxygen into the space until the sensor 30 no longer detects the selected property. Alternatively, the oxygen dispensing apparatus 10 can be configured such that when the actuating means 22 receives a signal from the sensor 30 it will cause the aerosol container 12 to dispense oxygen into the space for a predetermined interval, e.g., 1–30 seconds.

Of course, care should be taken so that none of the components used in carrying out the present invention will release sufficient electrical or thermal energy to cause ignition of a flammable or combustible atmosphere.

The sensor is chosen such that when it detects the preselected property, it will forward a signal to the actuating means that oxygen should be dispensed into the space. For example, in one embodiment, the sensor 30 may comprise one or more oxygen concentration sensors which signal the actuating means when the concentration of oxygen in the ambient atmosphere in the space drops below a predetermined level. Generally, oxygen levels between about 19.5 vol.% and about 23 vol.% are considered acceptable. When oxygen levels drop below about 19.5 vol.%, humans become lethargic and may become unconscious. Oxygen levels in excess of about 23 vol.% raise flammability concerns. Thus, in a preferred embodiment, the sensor signals the actuating means when the oxygen level drops below about 19.5 vol.%. In addition, the sensor could also be adapted such that it signals the actuating means to stop dispensing oxygen when the oxygen level reaches about 23 vol.%. In addition to signaling the actuating means when the oxygen level drops below the predetermined level, the sensor could also be configured to sound an alarm.

Alternatively, the sensor 30 may comprise one or more carbon monoxide sensors which signal the actuating means when the concentration of carbon monoxide in the ambient atmosphere of the space rises above a certain predetermined level. In a preferred embodiment, the sensor would signal the actuating means when the carbon monoxide concentration reaches the standard personal exposure limit of 35 ppm.

Those skilled in the art will appreciate that any number of commercially available oxygen sensors, carbon monoxide sensors, or the like could be used in the present invention without adversely effecting the performance and other advantages of the present invention.

Multiple oxygen dispensing apparatuses may be provided in a given area. In addition, an oxygen dispensing apparatus having multiple sensors could be provided, wherein some sensors are adapted to detect the concentration of oxygen while other sensors are adapted to detect the concentration of carbon monoxide or some other gas. Alternatively, multiple oxygen dispensing apparatuses could share the same sensor such that oxygen would be dispensed from multiple aerosol containers when the sensor detects the selected characteristic.

In an alternative embodiment, instead of utilizing a sensor, a timer (not shown) could be provided in electrical connection with the actuating means 22. More particularly, the timer could be configured to signal the actuating means at a predetermined interval (e.g., every hour, every two hours, or every four hours) in order to dispense oxygen into the enclosed space at a regular interval. Such an arrangement may be preferable in environments where regular dispensing of oxygen is desirable, e.g., short- or long-term health care facilities.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. An apparatus for selectively dispensing oxygen from a disposable hand-held, aerosol-type, pressurized container directly into the atmosphere of an enclosed space comprising a disposable hand-held, aerosol-type pressurized container comprising oxygen, a biased valve means permanently mounted onto the container and an actuator mounted to the valve means, wherein the valve means is movable between discharging and non-discharging positions by respective movement of the actuator, means for mounting the pressurized container such that upon movement of the actuator, the valve means is moved into the discharging position and oxygen is dispensed from the pressurized container through the valve means and actuator and directly into the enclosed space, electrically-operable actuating means comprising a solenoid mounted adjacent the actuator and an arm attached to the solenoid, the arm being movable relative to the actuator between discharged non-discharging positions, wherein when the arm is in the discharging position, the arm displaces the actuator and thereby moves the biased valve means into the discharging position, and when the arm is in the non-discharging position, the arm is positioned to allow the biased valve means to reside in the non-discharging position, and a sensor disposed in the enclosed space and in electrical connection with the actuating means for detecting a preselected property of the atmosphere in the enclosed space, wherein when the sensor detects the certain preselected property, the sensor signals the actuating means to move the arm into the discharging position and thereby displace the pressurized container actuator so that the biased valve means is moved into the discharging position, thereby providing for oxygen to be discharged directly into the enclosed space.

2. The apparatus of claim 1 wherein the mounting means comprises a bracket which supports a generally cylindrical structure which is adapted to retain the pressurized container within the structure.

3. The apparatus of claim 1 wherein the sensor comprises a device which detects the concentration of oxygen in the enclosed space.

4. The apparatus of claim 1 wherein the sensor comprises a device which detects the concentration of carbon monoxide in the enclosed space.

5. The apparatus of claim 1 wherein when the sensor detects the preselected property, the actuating means moves the actuator and thus the biased valve means into the discharging position for a predetermined period of time.

6. The apparatus of claim 1 wherein when the sensor detects the selected property, the actuating means moves the actuator and thus the biased valve means into the discharging position until the detection means no longer detects the selected property.

7. A method for selectively dispensing oxygen from a disposable hand-held, aerosol-type, pressurized container directly into an enclosed space having an atmosphere, the method comprising the steps of sensing the atmosphere in the space for a selected property, and automatically dispensing oxygen from an oxygen dispensing apparatus into the enclosed space when the selected property is sensed, the oxygen dispensing apparatus comprising a disposable hand-held, aerosol-type, pressurized container comprising oxygen, a biased valve means permanently mounted onto the container and an actuator mounted to the valve means, wherein the valve means is movable between discharging and non-discharging positions by respective movement of the actuator, means for mounting the pressurized container such that upon movement of the actuator, the valve means is moved into the discharging position and oxygen is dispensed from the pressurized container through the valve means and actuator and directly into the enclosed space, electrically-operable actuating means comprising a solenoid mounted adjacent the pressurized container actuator and an arm attached to the solenoid, the arm being movable relative to the actuator between discharging and non-discharging positions wherein when the arm is in the discharging position, the arm displaces the actuator and thereby moves the biased valve means into the discharging position, and when the arm is in the non-discharging position, the arm is positioned to allow the biased valve means to reside in the non-discharging position, and sensor disposed in the enclosed space and in electrical connection with the actuating means for detecting a preselected property of the atmosphere in the enclosed space, wherein when the sensor detects the certain preselected property, the sensor signals the actuating means to move the arm into the discharging position and thereby displace the pressurized container actuator so that the biased valve means is moved into the discharging position, thereby providing for oxygen to be discharged directly into the enclosed space.

8. The method of claim 7 further including the step of halting the dispensing of oxygen from the aerosol container after a predetermined interval.

9. The method of claim 7 further including the step of halting the dispensing of oxygen when the selected property is not sensed.

10. The method of claim 7 wherein the selected property is the average oxygen concentration in the enclosed space.

11. The method of claim 7 wherein the selected property is the presence of carbon monoxide.

* * * * *